US006050271A

United States Patent [19]

Spencer

[11] Patent Number: 6,050,271

[45] Date of Patent: Apr. 18, 2000

[54] HAIR COLORING APPLICATOR

[76] Inventor: Debra J. Spencer, 5 Oak Way, Southgate, London N14 5NP, United Kingdom

[21] Appl. No.: 09/307,344

[22] Filed: May 6, 1999

[51] Int. Cl.[7] ..... A45D 24/22

[52] U.S. Cl. ..... 132/112; 132/313; 132/320; 401/207

[58] Field of Search ..... 132/108, 112, 132/113, 114, 116, 313, 290, 320; 401/262, 269, 207

[56] References Cited

U.S. PATENT DOCUMENTS

| | | | |
|---|---|---|---|
| 2,197,579 | 4/1940 | Hooper | 401/269 |
| 2,895,486 | 7/1959 | Sayer | 401/207 |
| 2,897,826 | 8/1959 | Di Vito | 132/116 |
| 2,964,770 | 12/1960 | Lerner et al. | 132/320 |
| 3,961,635 | 6/1976 | Miya | 132/113 |
| 4,090,647 | 5/1978 | Dunning | 401/269 |
| 4,211,247 | 7/1980 | Morganroth | 132/320 |
| 4,277,193 | 7/1981 | Knaus | 401/269 |
| 4,594,015 | 6/1986 | Pomares | 401/207 |
| 4,881,558 | 11/1989 | Hollenberg et al. | 132/112 |
| 5,299,877 | 4/1994 | Birden | 401/207 |
| 5,597,255 | 1/1997 | Yager et al. | 401/207 |
| 5,829,976 | 11/1998 | Green | 401/269 |

*Primary Examiner*—Todd E. Manahan

[57] ABSTRACT

A hair coloring applicator system is provided including a bottle. Next provided is a brush including a hollow tube having a first end situated within the bottle. The brush further has a plurality of bristles mounted thereon adjacent to a second end thereof with a plurality of bores formed therebetween for allowing the excretion of hair coloring from the bottle and through the bores.

12 Claims, 3 Drawing Sheets

HAIR COLORING APPLICATOR

BACKGROUND OF THE INVENTION

1. Field of the Invention

The present invention relates to hair combs and more particularly pertains to a new hair coloring applicator for applying hair coloring in a precise and convenient manner.

2. Description of the Prior Art

The use of hair combs is known in the prior art. More specifically, hair combs heretofore devised and utilized are known to consist basically of familiar, expected and obvious structural configurations, notwithstanding the myriad of designs encompassed by the crowded prior art which have been developed for the fulfillment of countless objectives and requirements.

Known prior art hair combs and the like include U.S. Pat. No. 5,024,243; U.S. Pat. No. 3,861,407; U.S. Pat. Des. 374,741; U.S. Pat. No. 2,132,820; U.S. Pat. No. 5,152,305; and U.S. Pat. No. 4,872,594.

In these respects, the hair coloring applicator according to the present invention substantially departs from the conventional concepts and designs of the prior art, and in so doing provides an apparatus primarily developed for the purpose of applying hair coloring in a precise and convenient manner.

SUMMARY OF THE INVENTION

In view of the foregoing disadvantages inherent in the known types of hair combs now present in the prior art, the present invention provides a new hair coloring applicator construction wherein the same can be utilized for applying hair coloring in a precise and convenient manner.

The general purpose of the present invention, which will be described subsequently in greater detail, is to provide a new hair coloring applicator apparatus and method which has many of the advantages of the hair combs mentioned heretofore and many novel features that result in a new hair coloring applicator which is not anticipated, rendered obvious, suggested, or even implied by any of the prior art hair combs, either alone or in any combination thereof.

To attain this, the present invention generally comprises a transparent resilient bottle with a cylindrical configuration. The bottle has a bottom face and a tubular peripheral wall with a plurality of incremented measuring marks positioned thereon. A top face of the bottle has an aperture formed therein. The top face further has a threaded sleeve encompassing the aperture and extending upwardly therefrom. As best shown in FIG. 3, a cap is provided including an upper extent having a generally disk-shaped configuration with a hole formed in a top thereof. Associated therewith is a lower extent taking the form of a cylindrical sleeve with a threaded interior for engaging the threaded sleeve of the bottle. Lastly, an intermediate extent includes an annular indent. Also included is a brush having a resilient hollow tube with a consistent common diameter. As shown in FIG. 3, the tube is defined by a linear lower portion with a first length and an open end. The tube is further defined by a slightly arcuate upper portion with a second length less than the first length. The arcuate upper portion preferably has a constant predetermined radius of curvature. The upper portion of the tube further includes a multiplicity of short linear bristles mounted thereon. As shown in FIG. 4, the bristles extend radially from the tube at least a length approximately equal to a diameter of the tube. With continuing reference to FIG. 4, shown is a plurality of bores formed in the upper portion of the tube between the bristles. A size of the bores is larger toward an inboard end of the upper portion of the tube. In use, the lower portion of tube is removably inserted within the hole of the cap. When inserted, the brush of the present invention allows a user to excrete hair coloring from the bottle and through the bores of the brush.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair coloring applicator apparatus and method which has many of the advantages of the hair combs mentioned heretofore and many novel features that result in a new hair coloring applicator which is not anticipated, rendered obvious, suggested, or even implied by any of the prior art hair combs, either alone or in any combination thereof.

It is another object of the present invention to provide a new hair coloring applicator which may be easily and efficiently manufactured and marketed.

It is a further object of the present invention to provide a new hair coloring applicator which is of a durable and reliable construction.

An even further object of the present invention is to provide a new hair coloring applicator which is susceptible of a low cost of manufacture with regard to both materials and labor, and which accordingly is then susceptible of low prices of sale to the consuming public, thereby making such hair coloring applicator economically available to the buying public.

Still yet another object of the present invention is to provide a new hair coloring applicator which provides in the apparatuses and methods of the prior art some of the advantages thereof, while simultaneously overcoming some of the disadvantages normally associated therewith.

Still another object of the present invention is to provide a new hair coloring applicator for applying hair coloring in a precise and convenient manner.

Even still another object of the present invention is to provide a new hair coloring applicator that includes a bottle. Next provided is a brush including a hollow tube hiving a first end situated within the bottle. The brush further has a plurality of bristles mounted thereon adjacent to a second end thereof with a plurality of bores formed therebetween for allowing the excretion of hair coloring from the bottle and through the bores.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
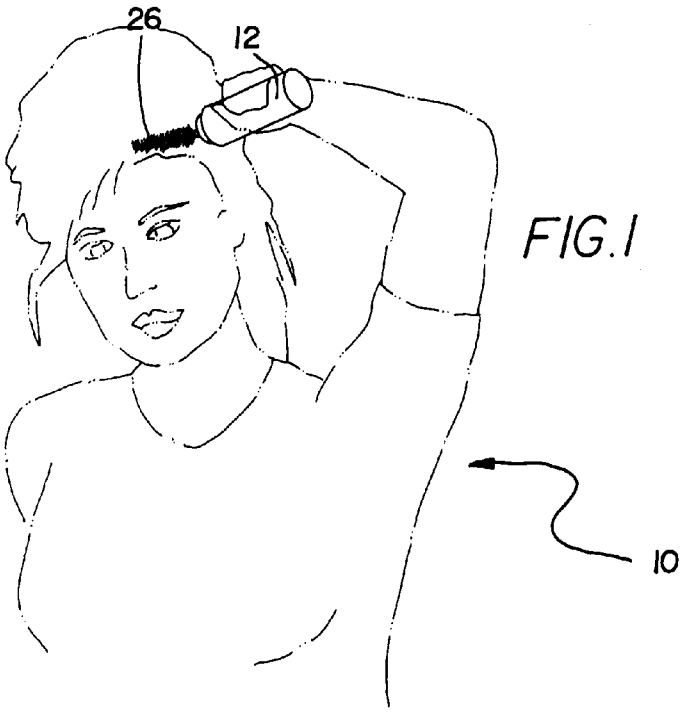
FIG. 1 is a perspective view of a new hair coloring applicator according to the present invention during use.
Figure 2:
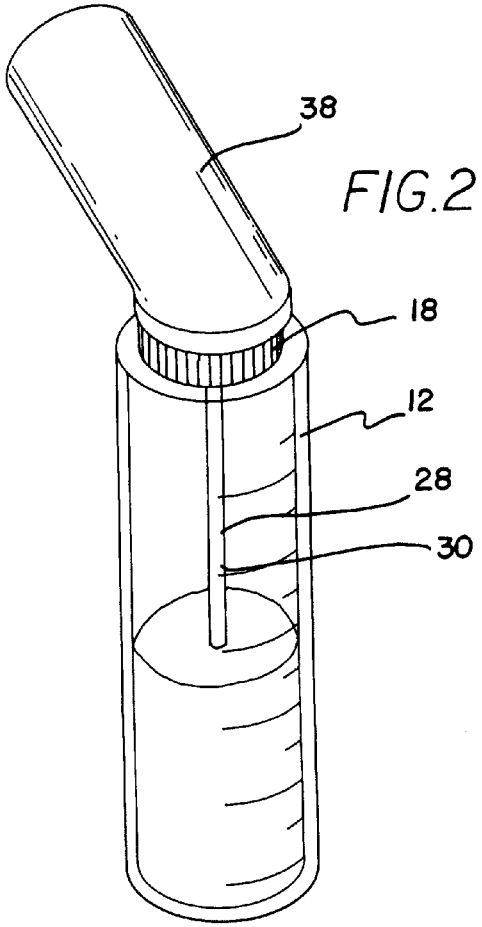
FIG. 2 is a perspective view of the present invention with the cap attached.

With reference now to the drawings, and in particular to FIGS. 1 through 6 thereof, a new hair coloring applicator embodying the principles and concepts of the present invention and generally designated by the reference numeral 10 will be described.

The present invention, designated as numeral 10, includes a transparent resilient bottle 12 with a cylindrical configuration. The resilient nature of the bottle affords a generally firm bottle that may be deformed with a predetermined amount of exterior pressure. The bottle has a bottom face and a tubular peripheral wall with a plurality of incremented measuring marks positioned thereon. A top face of the bottle has an aperture 14 formed therein. The top face further has a threaded sleeve encompassing the aperture and extending upwardly therefrom.

Figure 3:
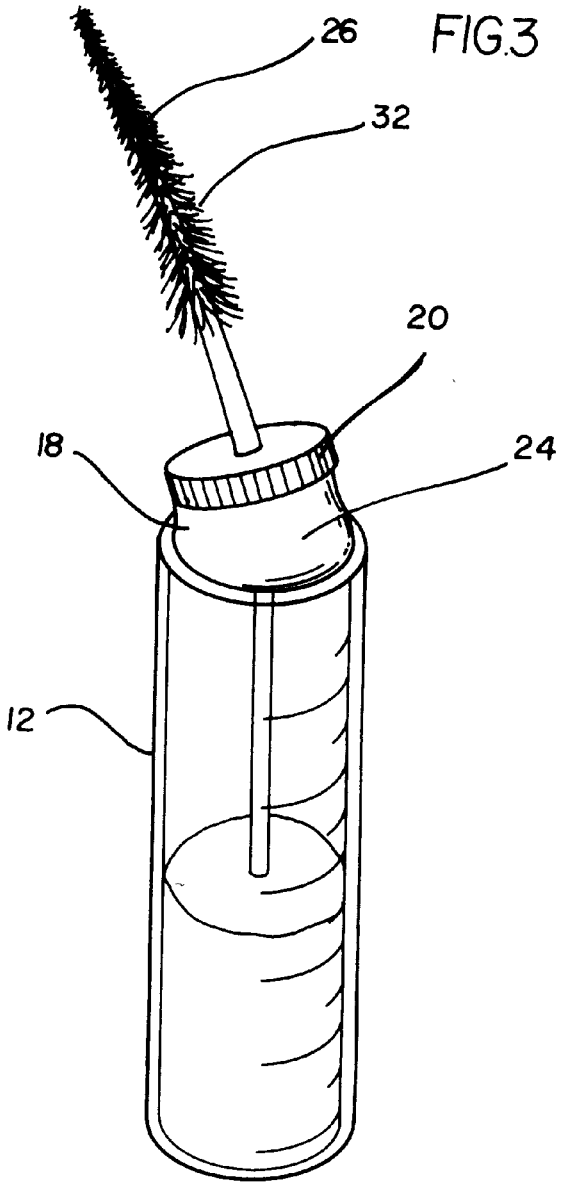
FIG. 3 is a perspective view of the present invention without the cap and the brush being exposed.

As best shown in FIG. 3, a cap 18 is provided including an upper extent 20 having a generally disk-shaped configuration with a hole formed in a top thereof. Associated therewith is a lower extent taking the form of a cylindrical sleeve with a threaded interior surface for engaging the threaded sleeve of the bottle. The upper extent preferably has a knurled outer surface. Lastly, a tapered intermediate extent 24 of the cap is positioned between the upper extent and the lower extent and includes an annular indent. As shown in FIG. 3, a plane in which the upper extent resides remains at an angle between about 30–60 degrees with respect to a horizontal. Ideally, the cap is constructed from a resilient, flexible material similar to that from which the bottle is constructed. It should be noted that the threaded sleeve of the bottle and the threaded lower extent of the cap may be done away with in favor of an integral coupling between the intermediate extent and the bottle. See FIG. 3.

Also included is a brush 26 having a resilient hollow tube 28. As shown in FIG. 3, the tube is defined by a linear lower portion 30 with a first length and an open end. The lower portion of the tube is equipped with a consistent common diameter along its length. The tube is further defined by a slightly arcade and slanted upper portion 32 with a second length less than the first length. The arcuate upper portion preferably has a constant predetermined radius of curvature and a tapering diameter. Note FIG. 4. As shown in FIG. 3, the upper portion of the tube remains generally along an axis which is normal to the top of the upper extent of the cap.

Figure 4:
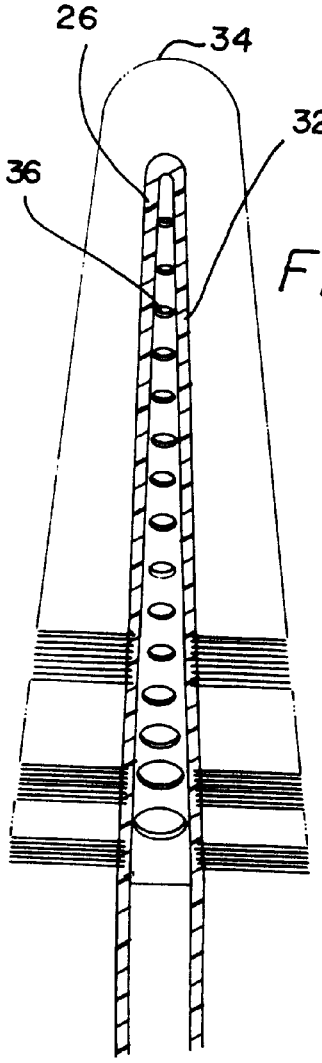
FIG. 4 is a close-up cross-sectional view of the brush of the present invention with the brush rotated 90 degrees with respect to FIG. 3 such that the taper in the brush is undetected.

The upper portion of the tube further includes a multiplicity of evenly spaced short linear bristles 34 mounted thereon along about ¾ a length of the tube thereby rendering a smooth base portion. As shown in FIG. 4, the bristles extend radially from the tube at least a length approximately equal to a diameter of the tube. With continuing reference to FIG. 4, shown is a plurality of bores 36 formed in the upper portion of the tube between the bristles. Ideally, the bores are equally spaced and oval in shape. Further, a size of the bores and a length and diameter of the bristles are larger toward an inboard end of the upper portion of the tube. As shown in the Figures, the upper portion of the tubes has a length which is about ½ that of the bottle.

In use, the lower portion of tube is removably inserted within the hole of the cap. When inserted, the brush of the present invention allows a user to excrete hair coloring from the bottle and through the bores of the brush in a precise manner. By this structure, hair coloring from the bottle may be applied to hair follicles of various parts of the user. For example, mustaches, eyebrows, sideburns, hair parts, and other areas of hair may have hair coloring applied thereon. In the preferred embodiment, the total length of the present invention is about 5 and ½ inches.

Finally, a cover 38 is provided including a cylindrical top portion with a diameter about equal to that of the bottle. A lower portion of the cover takes the form of a cylindrical sleeve which is formed about an axis that defines an obtuse angle with an axis about which the top portion is formed. It should be noted that the lower portion of the cover has an annular indent for snappily engaging the annular detent of the cap. By this structure, the top portion of the cover contains and protects the brush when not in use.

Figure 5:
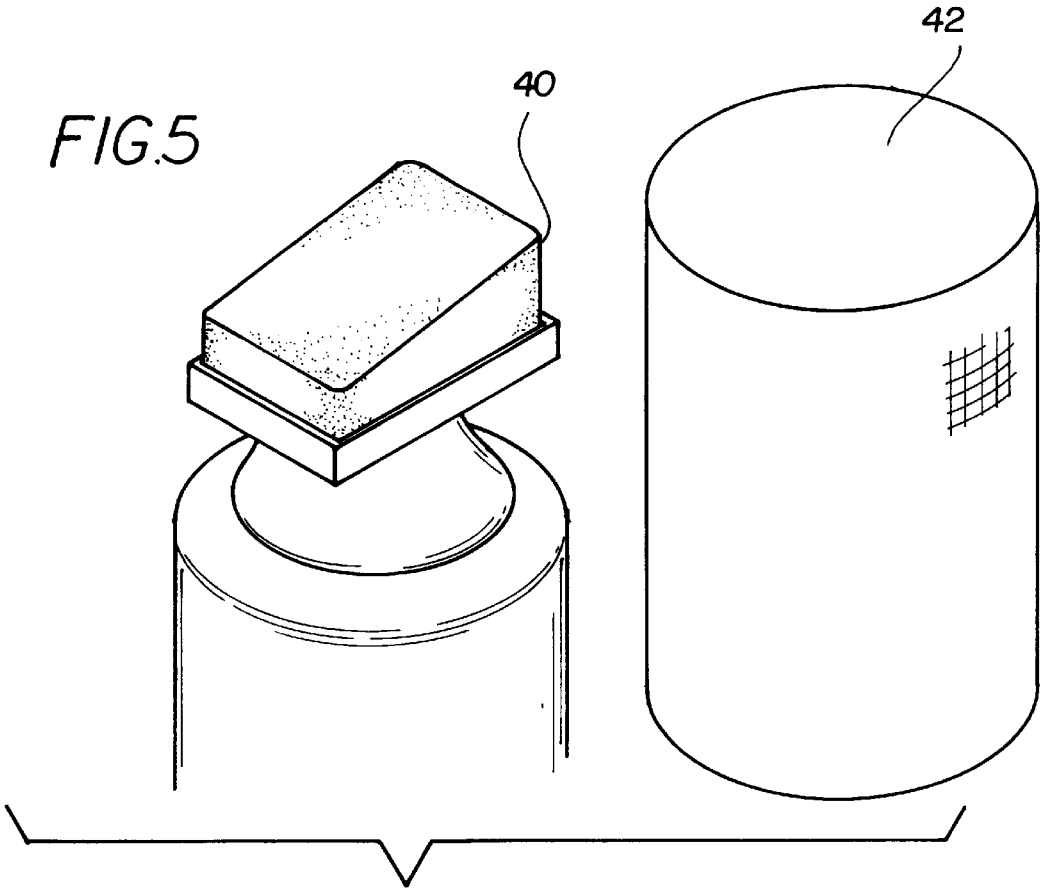
FIG. 5 is an exploded perspective view of an alternate embodiment of the present invention.
Figure 6:
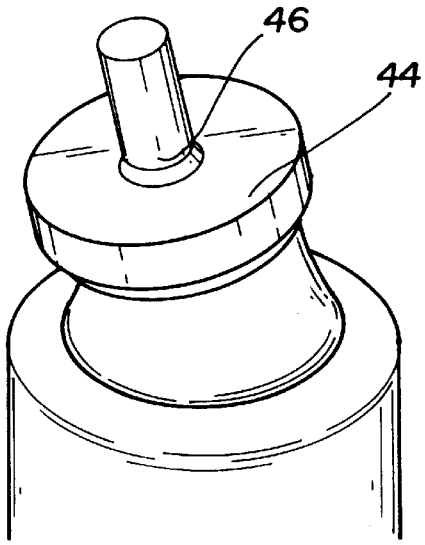
FIG. 6 is a perspective view of another alternate embodiment.

In alternate embodiment as shown in FIG. 5, the brush is replaced with a sponge 40 which is mounted within a cutout formed in the top of the upper extent of the cap. The sponge has a beveled top face and a periphery defined by a pair of elongated side faces and a pair of short end faces. A removable cylindrical cap is preferably included for selectively covering the sponge. It should be noted that in additional alternate embodiments, a dropper 44 or the like may be mounted on the cap in lieu of the brush or sponge. Note FIG. 6. As shown, such dropper preferably has an angled cylindrical spout 46.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair coloring applicator system comprising, in combination:

a transparent resilient bottle with a cylindrical configuration having a bottom face, a tubular peripheral wall with a plurality of incremented measuring marks positioned thereon, and a top face having an aperture formed therein, the top face further having a threaded sleeve encompassing the aperture and extending upwardly therefrom;

a cap including an upper extent having a generally disk-shaped configuration with a hole formed in a top thereof, a lower extent taking the form of a cylindrical sleeve with a threaded interior for engaging the threaded sleeve of the bottle, and an intermediate extent including an annular depression:

a brush including a resilient hollow tube having a consistent common diameter, the tube defined by a linear lower portion with a first length and an open end, the tube further defined by a slightly arcuate upper portion with a second length less than the first length and a constant predetermined radius of curvature, the upper portion of the tube further including a multiplicity of short linear bristles mounted thereon and extending radially therefrom a length approximately equal to a diameter of the tube and a plurality of bores formed in the upper portion of the tube between the bristles, a size of the bores being larger toward an inboard end of the upper portion of the tube, wherein the lower portion of tube is removably inserted within the hole of the cap for allowing user excrete hair coloring from the bottle and through the bores; and a cover including a cylindrical top portion with a diameter about equal to that of the bottle and a lower portion taking the form of a cylindrical sleeve which formed about an axis that defines an obtuse angle with an axis about which the top portion is formed, wherein the lower portion of the cover has an annular indent for snappily engaging the annular depression of the cap such that the top portion of the cover contains the brush.

2. A hair coloring applicator system comprising:

a bottle;

a cap including an upper extent having a generally disk-shaped configuration with a hole formed in a top thereof, a lower extent for removably coupling to the bottle and an intermediate extent including an annular depression; and a brush including a hollow tube, the brush further having a plurality of bristles mounted to the tube, the bristles extending outward from the tube perpendicular to an outer surface of the tube, the bristles being mounted on a portion of the outer surface extending all the way around the tube, the bristles being adjacent to a second end of the brush with a plurality of bores formed between the bristles for allowing the excretion of hair coloring from the bottle and through the bores, a lower portion of the tube being removably inserted in the hole of the cap for allowing user excrete hair coloring from the bottle and through the bores.

3. The hair coloring applicator system as set forth in claim 2 wherein the tube has a tapering diameter adjacent to the second end thereof.

4. The hair coloring applicator system as set forth in claim 2 wherein the tube is arcuate adjacent to the second end thereof.

5. The hair coloring applicator system as set forth in claim 2 wherein the bristles are resilient and extend from the tube a distance about equal to a diameter of the tube.

6. The hair coloring applicator system as set forth in claim 2 wherein the tube is removably coupled to the bottle.

7. The hair coloring applicator system as set forth in claim 2 and further including a cover for containing the brush when not in use.

8. The hair coloring applicator system as set forth in claim 2 wherein a size of the bores is smaller toward the second end of the tube.

9. The hair coloring applicator system as set forth in claim 2 wherein a length of the bristles is shorter toward the second end of the tube.

10. A hair coloring applicator system comprising:

a bottle;

a cap including an upper extent having a generally disk-shaped configuration with a hole formed in a top thereof, a lower extent for removably coupling to the bottle and an intermediate extent including an annular depression; and applicator means connected to the cap for allowing the excretion of hair coloring from the bottle.

11. The hair coloring applicator system as set forth in claim 10 wherein the applicator means includes a sponge mounted on the cap with a beveled top for allowing the excretion of hair coloring from the bottle and through the sponge.

12. The hair coloring applicator system as set forth in claim 10 wherein the applicator means includes a dropper having an angled substantially cylindrical spout.

* * * * *